US007101203B2

(12) United States Patent
Saethre et al.

(10) Patent No.: US 7,101,203 B2
(45) Date of Patent: Sep. 5, 2006

(54) METHOD AND APPARATUS FOR ELECTRONICALLY INTERCONNECTING HIGH VOLTAGE MODULES POSITIONED IN RELATIVELY CLOSE PROXIMITY

(75) Inventors: Robert B. Saethre, San Diego, CA (US); Paul C. Melcher, El Cajon, CA (US); George X. Ferguson, San Diego, CA (US)

(73) Assignee: Cymer, Inc., San Diego, CA (US)

( * ) Notice: Subject to any disclaimer, the term of this patent is extended or adjusted under 35 U.S.C. 154(b) by 181 days.

(21) Appl. No.: 10/606,412

(22) Filed: Jun. 25, 2003

(65) Prior Publication Data

US 2004/0266235 A1 Dec. 30, 2004

(51) Int. Cl.
*H01R 13/62* (2006.01)

(52) U.S. Cl. ..... 439/152

(58) Field of Classification Search ..... 439/152, 439/310, 159, 157, 445, 447, 201, 160, 194, 439/449, 453–459
See application file for complete search history.

(56) References Cited

U.S. PATENT DOCUMENTS 4,795,356 A * 1/1989 Pauza ..... 439/225
5,149,275 A * 9/1992 Pitta ..... 439/98
5,857,868 A * 1/1999 Findon et al. ..... 439/310
5,890,926 A * 4/1999 Pauza et al. ..... 439/445
6,237,690 B1 * 5/2001 Nicholson ..... 166/338
6,283,781 B1 * 9/2001 Mori ..... 439/310

* cited by examiner

*Primary Examiner*—P. Austin Bradley
*Assistant Examiner*—Edwin A. Leon
(74) *Attorney, Agent, or Firm*—William Cray

(57) ABSTRACT

Apparatus and method for electrically connecting two closely positioned high voltage modules with little or no bend and without any loops in an electrical interconnecting coaxial cable may have a high voltage connector attached to at least a portion of the cable on at least one end of the cable; a push through high voltage connector receptor within one module; and a disconnection mechanism within the one module adapted to move the high voltage connector and at least a portion of cable to which the high voltage connector is attached through the connector receptor from a contact position to a housed position in a direction away from the other module to which high voltage connection is to be made. The connector receptor may have an open cylindrical connector with a contacting surface contained on the interior wall of the cylindrical connector and an interlock mechanism.

66 Claims, 10 Drawing Sheets

METHOD AND APPARATUS FOR ELECTRONICALLY INTERCONNECTING HIGH VOLTAGE MODULES POSITIONED IN RELATIVELY CLOSE PROXIMITY

FIELD OF THE INVENTION

The present invention relates to high pulse powered electrical equipment and other high voltage electrical equipment which is segregated into modules which in turn are positioned relatively close to each other, e.g., in a cabinet, e.g., housing other equipment, e.g., the optics, laser chambers and associated other equipment for a very high power very high pulse rate excimer laser.

BACKGROUND OF THE INVENTION

In high pulse powered electrical equipment and other high voltage electrical equipment which is segregated into modules which in turn are positioned relatively close to each other, e.g., in a cabinet, e.g., housing other equipment, e.g., the optics, laser chambers and associated other equipment for a very high power very high pulse rate excimer laser, there is a need for conservation of space. At the same time it is necessary interconnection of modules with high voltage over a relatively robust and therefore also relatively inflexible high voltage cable, e.g., a coaxial cable, formed, e.g., of an internal high voltage connection wire, e.g., copper wire, surrounded by a relatively thick sheath of relatively inflexible insulating material, e.g., Polyethylene, surrounded by a relatively flexible ground connection formed, e.g., of a woven mesh of conductor material, e.g., copper mesh, which is in turn surrounded by an also relatively inflexible outer sheath of insulating material, e.g., plastic or synthetic or actual rubber, e.g., neoprene. In certain applications, e.g., generation of very finely tuned very short wavelength and narrow band width light for applications, e.g., semiconductor manufacturing lithography applications, interconnecting cables with unwanted loops or even perhaps bending of the cabling can cause undesired electrical effects, e.g., unwanted and/or misplaced inductances. For both ease of installation and ease of removal for maintenance of for interchange there is a need for the ability to interconnect such modules with such relatively inflexible cabling without significantly bending, twisting, crimping, looping or the like of the cabling, which can cause the above mentioned ill effects or perhaps also damage component parts within the modules during an installation or removal process.

SUMMARY OF THE INVENTION

An apparatus and method for electrically connecting two closely positioned high voltage modules with little or no bend and without any loops in an electrical interconnecting coaxial cable, is disclosed, which may comprise a high voltage connector attached to at least a portion of the cable on at least one end of the cable; a push through high voltage connector receptor within one module; and a disconnection mechanism within the one module adapted to move the high voltage connector and the at least a portion of cable to which the high voltage connector is attached through the connector receptor from a contact position to a housed position in a direction away from the other module to which high voltage connection is to be made. The high voltage connector receptor may comprise an open cylindrical connector with a contacting surface contained on the interior wall of the cylindrical connector. The apparatus may further comprise an interlock mechanism in operative connection with the disconnection mechanism and adapted to provide an indication of the high voltage connector being in a position other than in the contact position relative to the connector receptor, and an engaging mechanism engaging the cable and holding the cable in a fixed position relative to the disconnection mechanism as the high voltage connector moves between the contact position and the housed position. The apparatus may further comprise a clamping mechanism in cooperative connection with the disconnection mechanism when the high voltage connector is in the contact position and cooperative with the clamping mechanism to prevent the high voltage connector from moving from the contact position. The invention may also include a retractable connector within a second module moveable toward the first module from a retracted position into an extended position, in which extended position electrical contact is made with the second high voltage connector.

DETAILED DESCRIPTION OF PREFERRED EMBODIMENTS

Figure 1:
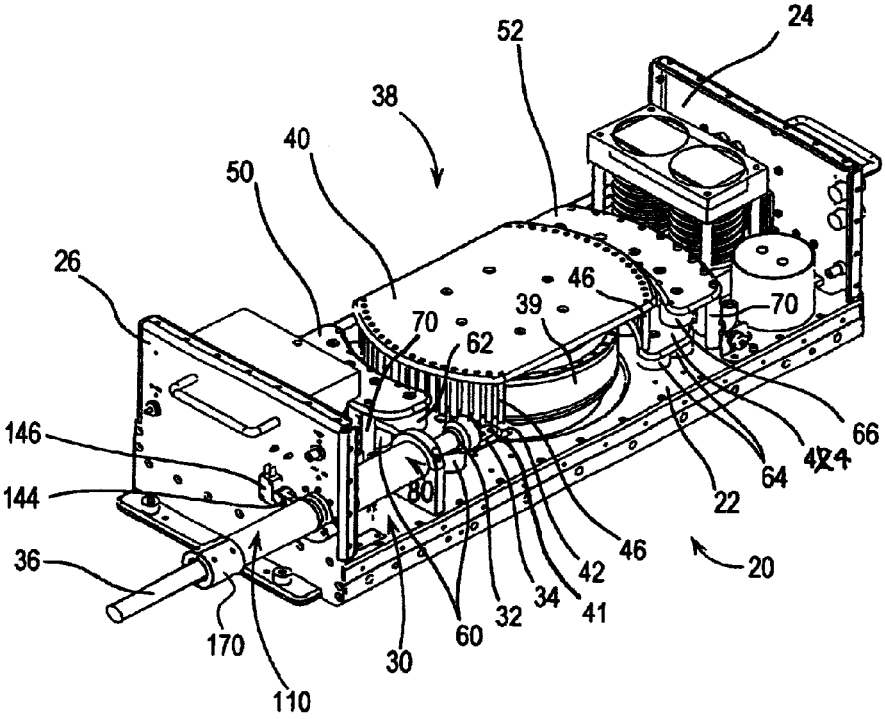
FIG. 1 shows a perspective view of a high voltage pulse power system module according to an embodiment of the present invention.
Figure 2:
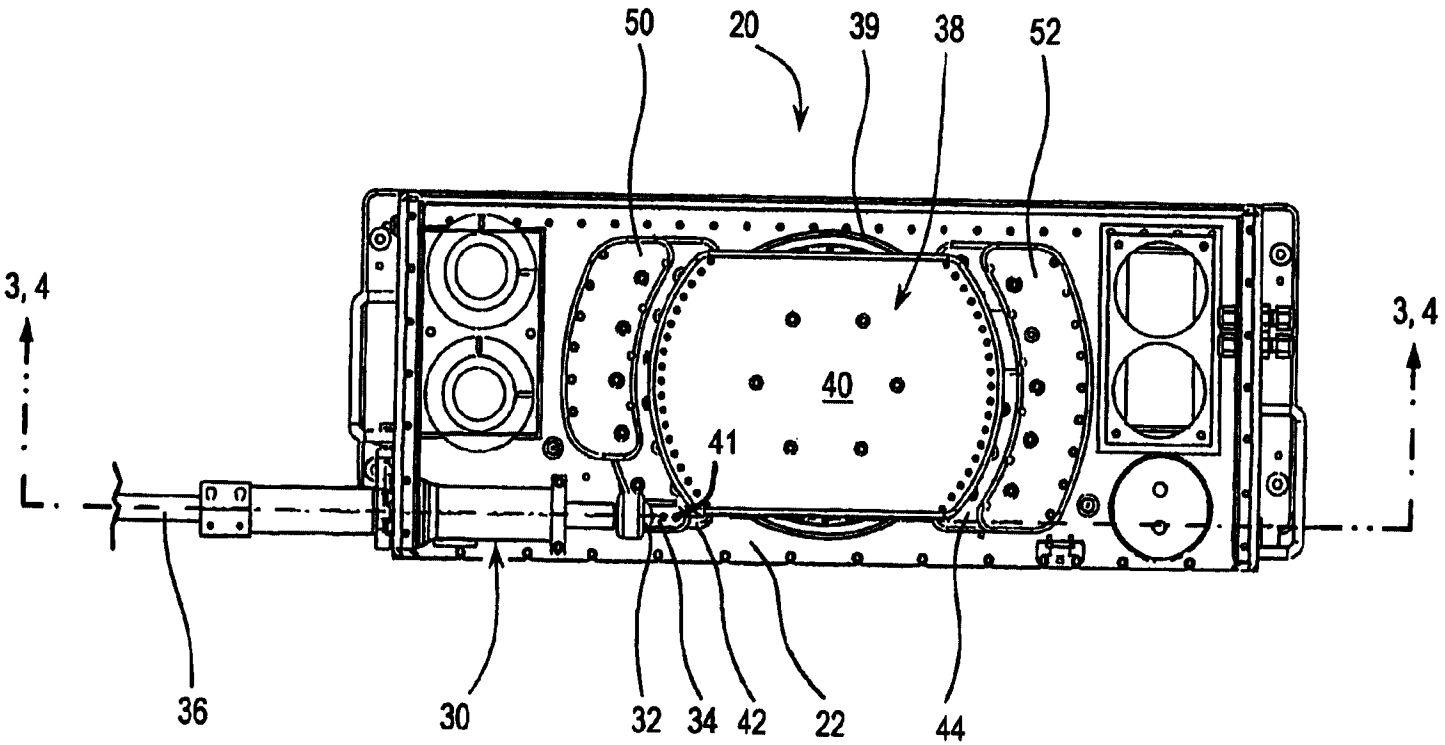
FIG. 2 shows a top view of the module of FIG. 1.

Turning now to FIGS. 1 and 2 there is shown a high voltage pulse power module 20, e.g., a compression head. The module 20 has a base 22 and a module rear wall 24 and a module front wall 26. Also shown is a high voltage input connector assembly 30, which may include, e.g., a high voltage connector 32 and a high voltage connector receptor 34. The high voltage connector 32 may be attached at the terminal end of a high voltage cable 36, which may be a coaxial cable sold by Times Microwave under the name RG 177 or RG 220, or compliant with the specifications MILA/67-PG-177 and/or MIL 17/81-00001, having, e.g., a central high voltage wire 37 and a grounded sheath made of, e.g., a cylindrical woven copper mesh 35.

Contained on the module 20 may also be a magnetic inductive reactor element 38, which may be contained in, e.g., a housing 39. The magnetic inductive reactor element 38 may have an inductive reactor input contact plate 40 in electrical contact with an element (not shown) forming a portion of, e.g., a first turn around a magnetic core (not shown), both contained within the housing 39. The high voltage connector receptor 34 may be attached by screws 41 to front capacitor bank input contact plate 42. The front capacitor input contact plate 42 may also be connected electrically to the inductive reactor input plate 40 by a plurality of standoffs 46. The reactor input plate 40 may also be connected electrically to a rear capacitor input contact plate 44 by another plurality of standoffs 46.

Each of a plurality of front capacitor bank bottom capacitors 60 may be connected electrically to the front capacitor bank input connector plate 42 and also to the module base 22, which may be maintained at a common or ground potential. Each of a plurality of front capacitor bank upper capacitors 62 may be connected electrically to the front capacitor bank input plate 42 and to a front to capacitor ground plate 50, which may be connected electrically to the base 22 by a plurality of standoffs 70. Each of a plurality of rear capacitor bank bottom capacitors 64 may be electrically connected to the rear capacitor bank input plate 44 and to the base 22. Each of a plurality of rear capacitor bank top capacitors 66 may be connected to the rear capacitor bank input connector plate 44 and to a rear capacitor bank top capacitor ground plate 52, which may be connected to the base 22 by another plurality of standoffs 70.

Figure 3:
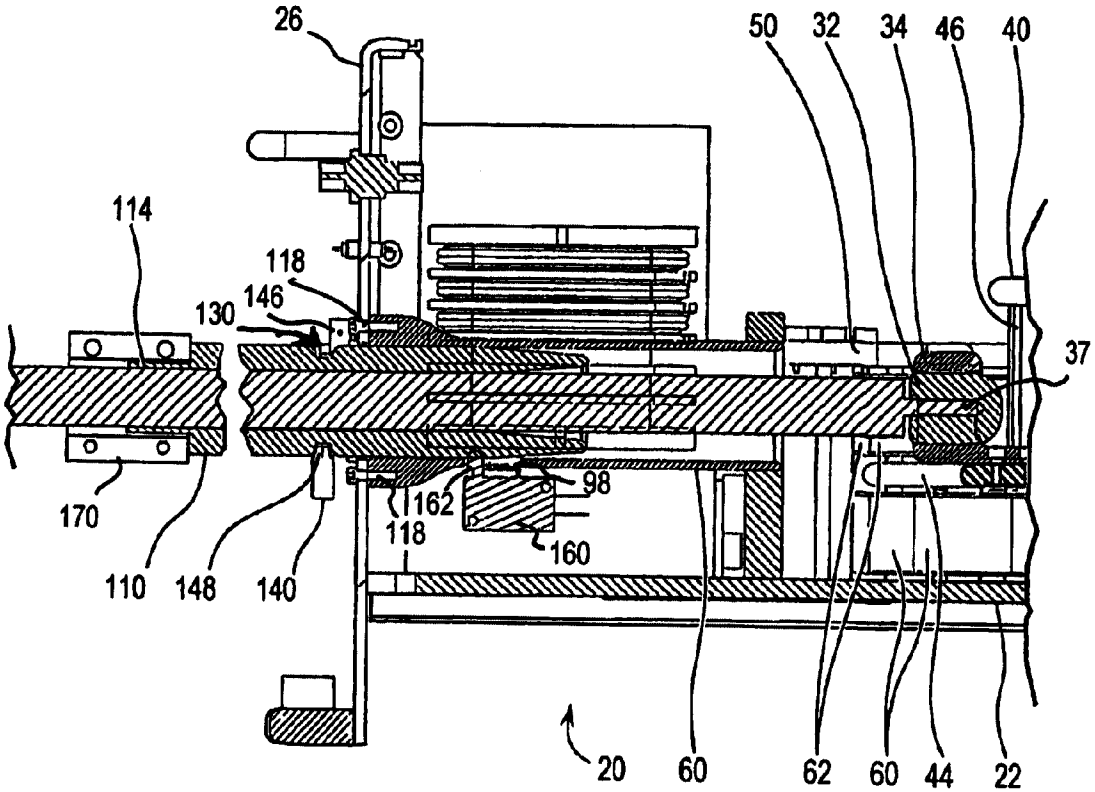
FIG. 3 shows a cross-sectional view of a portion of the module of FIGS. 1 and 2, along section lines 3,4—3,4 in FIG. 2, with a high voltage connector in the contact position according to an embodiment of the present invention.
Figure 5:
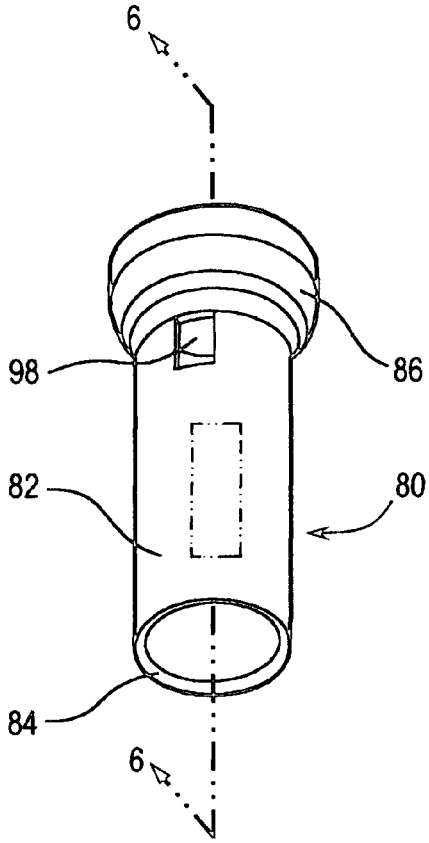
FIG. 5 shows a perspective view of a high voltage connector base tube according to an embodiment of the present invention.
Figure 6:
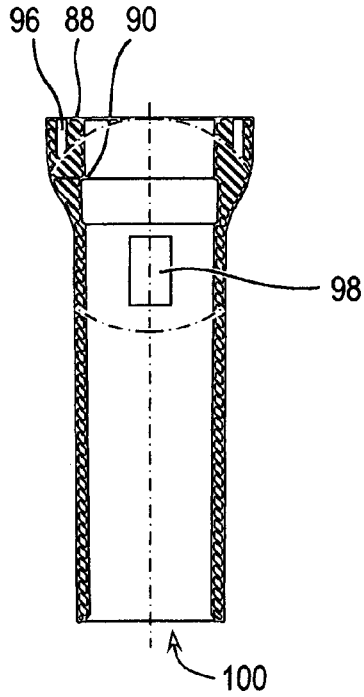
FIG. 6, shows a cross-sectional view of the connector base tube of FIG. 5 along section lines 6—6 in FIG. 5.

Turning now to FIG. 3 there is shown the module of FIGS. 1 and 2 partially cut away and in cross section along the section lines 3,4—3,4 in FIG. 2. The high voltage connector assembly 30 is shown to include, e.g., a high voltage input connector base tube 80, also shown in perspective view in FIG. 5 and in cross section in FIG. 6 along the section lines 6—6 in FIG. 5. The base tube 80 may have an elongated cylindrical section 82 with one end of the cylindrical section 82 having a rounded end 84. The other end of the cylindrical section 82 may form a flared end 86 ending in a flat end portion 86 in which may be contained a plurality of threaded screw openings 96. The flared end 86 may also have an opening 90 with a slightly enlarged cylindrical interior diameter. The base tube 80 may also have formed within the cylindrical section 82 a generally cylindrical window 98. The elongated cylindrical section 82 and the enlarged section 90 together form an elongated cylindrical passage 100.

Figure 7:
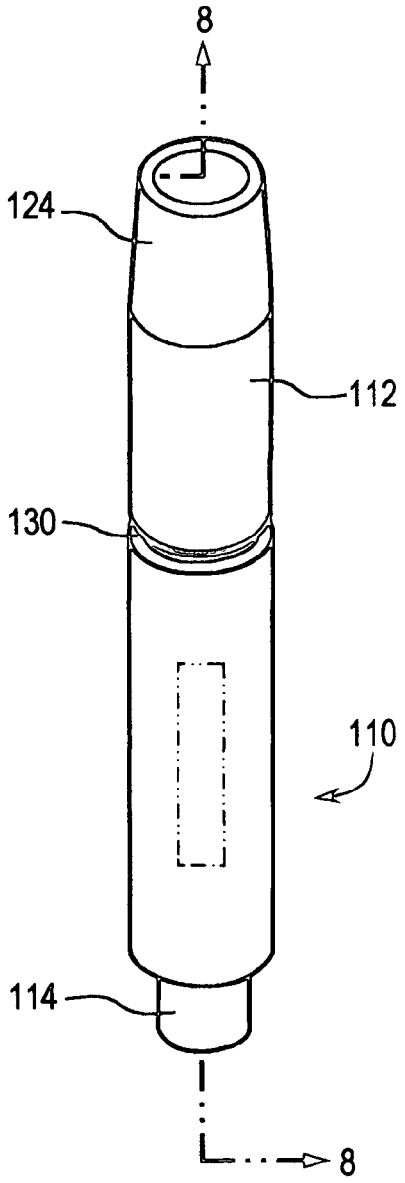
FIG. 7 shows a perspective view of a center tube according to an embodiment of the present invention.
Figure 8:
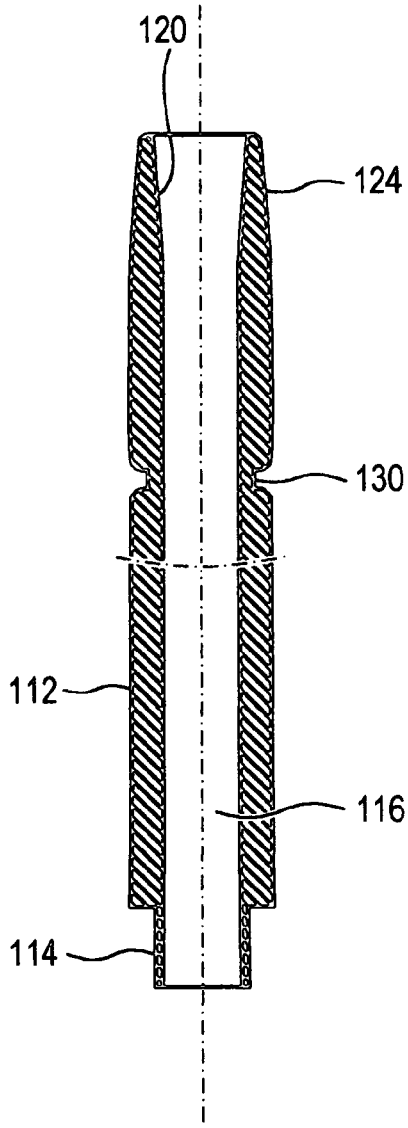
FIG. 8 shows a cross-sectional view of the center tube of FIG. 7 along section lines 8—8 in FIG. 7.

Inserted within the interior of the elongated cylindrical section 82 for slideable motion within the base tube 80 may be a high voltage input assembly center tube 110, also shown in perspective view in FIG. 7 and in cross section along the sectional lines 8—8 in FIG. 7. The center tube 110 may be formed of a relatively thicker walled elongated cylindrical section 112 and may have at one end a thinner walled clamping section 114. The interior of the center tube 110 may form an elongated center passage 116. The other end of the center tube 110 elongated cylindrical section 112 may form a flared opening section 120 with the outer shell of the center tube 110 tapering in a tapered section 124 corresponding in length essentially with the flared portion 120. The outer wall of the center tube 110 elongated cylindrical section 112 may have formed in it an annular clamping and interlock groove 130.

Figure 9:
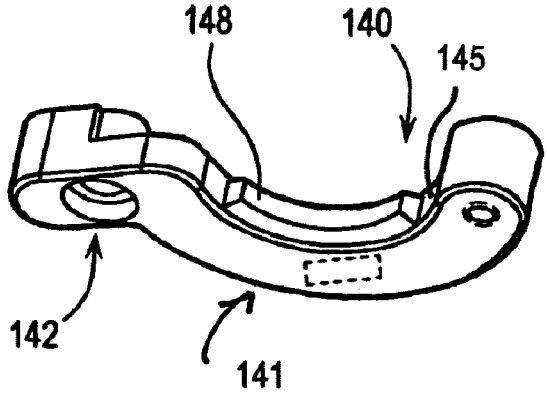
FIG. 9 shows a perspective view of a high voltage input clamp according to an embodiment of the present invention.

Turning now to FIG. 9 there is shown in perspective view a high voltage input connector clamp 140 which may be pivotally attached to the module front wall 26 by a pivot pin 144, shown in FIG. 1, inserted through a pivot pin opening 142 at one end of an arcuate member 141 forming the clamp 140. The arcuate member 141 may have on its interior arced surface 145 a clamping protrusion 148.

Figure 4:
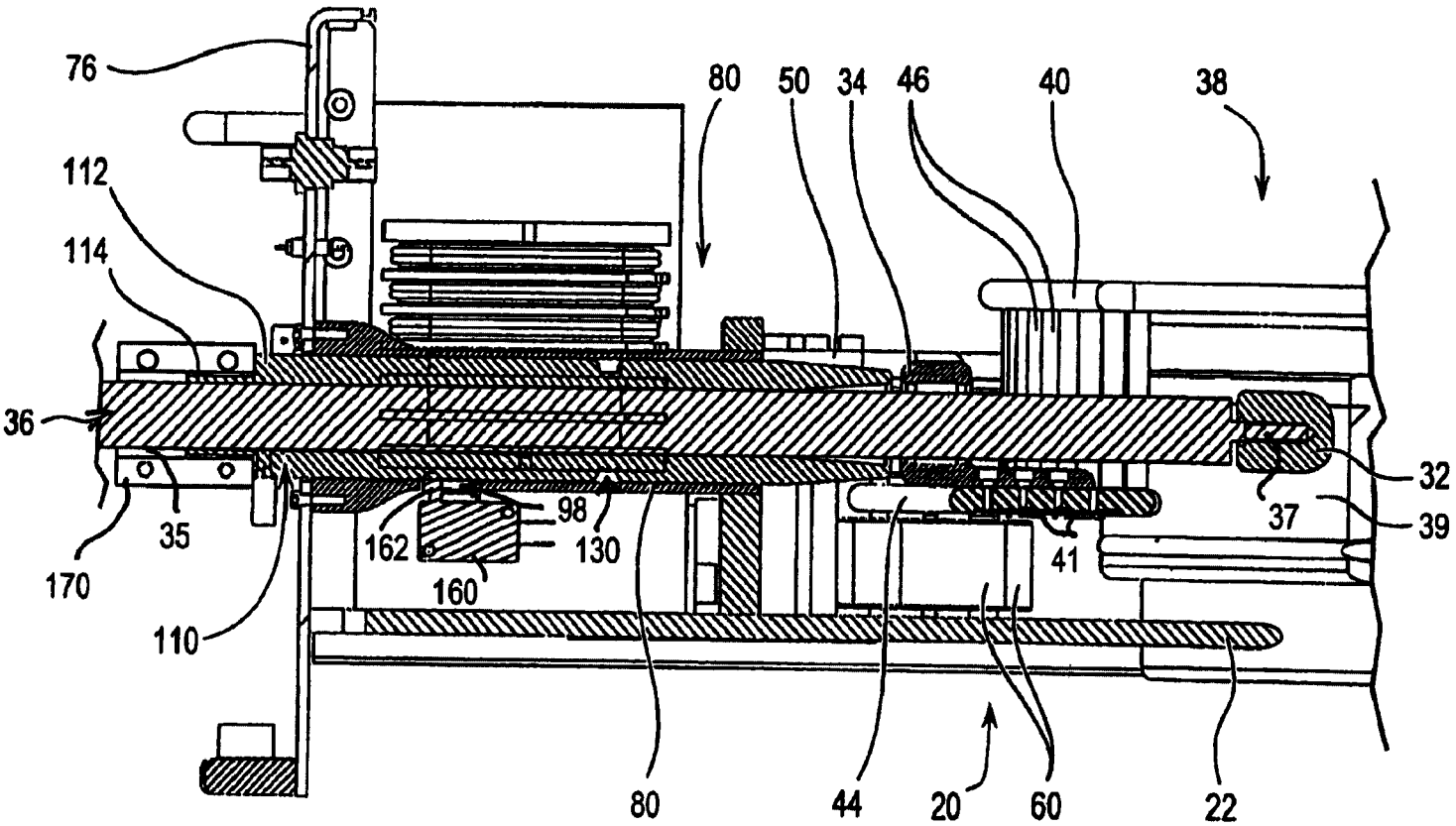
FIG. 4 shows a cross-sectional view of a portion of the module of FIGS. 1 and 2, along section lines 3,4—3,4 in FIG. 2, with a high voltage connector in a housed position according to an embodiment of the present invention.
Figure 10:
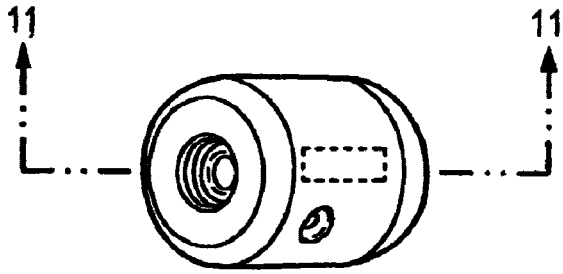
FIG. 10 shows a perspective view of a high voltage input connector according to an embodiment of the present invention.
Figure 11:
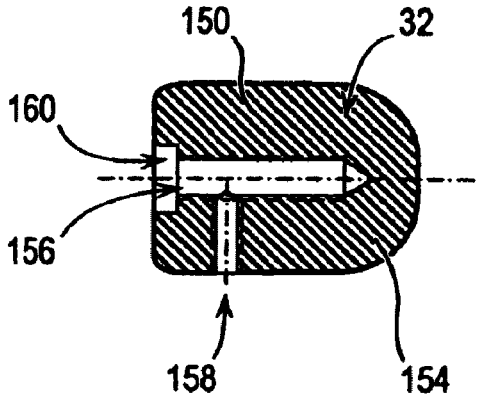
FIG. 11 shows a cross-sectional view of the high voltage input connector of FIG. 10 along section lines 11—11 in FIG. 10.

Turning now to FIG. 10 there is shown the high voltage input connector 32 that is also shown in cross section in FIG. 11 along sectional lines 11—11 in FIG. 10. The high voltage connector 32 may be formed of a short cylindrical section 150 and a rounded front section 154. The short cylindrical section 150 and a small portion of the rounded section 154 may have formed within them a threaded channel 156 which may have a larger opening section 160. The channel may receive the wire portion 37 of the high voltage cable 36, as shown in FIGS. 3 and 4 and may be held in that position and in electrical contact with the high voltage connector 32 by a set screw (not shown) which may be threaded into a threaded set screw opening 158 in the high voltage connector.

Figure 12:
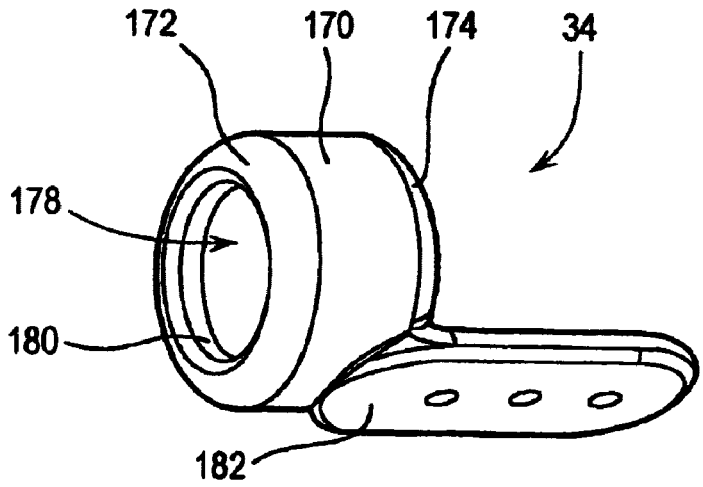
FIG. 12 shows a perspective view of a high voltage input connector receptor according to an embodiment of the present invention.
Figure 13:
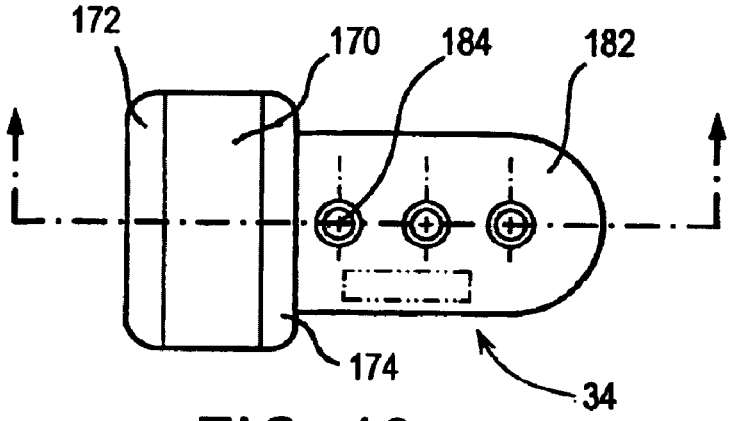
FIG. 13 shows a top view of the high voltage input connector receptor of FIG. 12.
Figure 14:
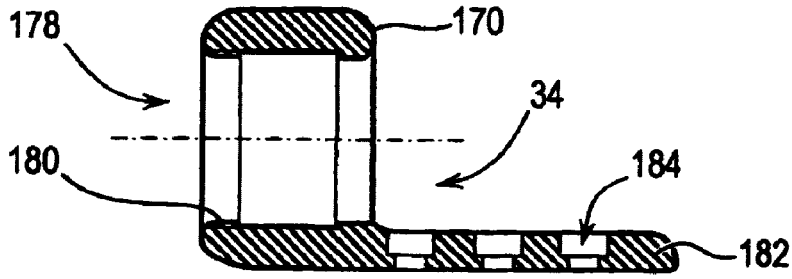
FIG. 14 shows a cross-sectional view of the high voltage input connector receptor of FIG. 13 along section lines 14—14 of FIG. 13.

Turning now to FIG. 12 there is shown a perspective view of the high voltage connector receptor 34, which is also shown in plan view in FIG. 13 and in cross-sectional view in FIG. 14 along sectional lines 14—14 in FIG. 13. The high voltage connector receptor 34 may be formed of a short cylindrical section 170 having a rounded front face 172 and a rounded rear face 174 and forming a generally cylindrical opening 178 having slightly narrower internal diameters at the front and rear formed by a respective one of a pair of protruding surfaces 180. The high voltage connector receptor cylindrical portion 170 may be attached to a plate section 182, which may have formed in it a plurality of openings for receiving, e.g., a plurality of screws 41 shown in FIGS. 1–4.

Turning now to FIGS. 1–4 it can be seen that in operation the high voltage connector 32 is engaged and relatively snugly held in place within the interior passage 178 of the of the high voltage connector receptor 34. At the same time, the cable 36 is held within the high voltage input connector assembly 30 by a cable clamp 170, which frictionally engages the cable clamping sleeve 114 of the center tube 110. At the same time the center tube 110 is snuggly fit within and frictionally engaging the interior surface of the elongated cylindrical passage 100 of the base tube 80, which in turn is connected to the housing front wall 26 by screws 118. Multilam (not shown) may also be employed to make electrical contact with the cable 37.

In this position of the high voltage connector assembly 30, the clamping protrusion 148 of the high voltage input connector clamp 140 is engaging the annular groove 130 in the inner tube 110, preventing the high voltage connector 32 from moving out from within the opening 178 in the high voltage connector receptor 32. In addition, a micro-switch 160 contact 162, extending through the window 98 in the base tube 80 engages the tapered outer surface 124_of the center tube 110.

When the module 20 is first to be installed and/or the operator desires to remove the module, the cable 36 and the high voltage connector assembly 30 will be in the position/or moved into the position shown in FIG. 4. In this position the high voltage connector 32 has been thrust through the opening 178 in the high voltage connector receptor 34 toward the rear wall 24 of the module 20. In order to do this, the operator (or alternatively at the factory before shipping) releases the clamp 140 from the annular groove 130 and pushes the inner tube 110 within the base tube 80 to a position, e.g., where the cable sleeve clamp 170 is abutting the clamp 140. In addition, with the clamp 140 out of the annular groove 130, the micro-switch 146 mounted on the module 20 front wall 26 is moved to a position to indicate the clamp 140 is disengaged from the annular groove 130 and also the micro-switch 160 spring loaded contact element 162 is in a position resting against the cylindrical outer wall 112 of the inner tube 110, also indicating that the cable is in a "housed" position, i.e., not in the operating electrical contact position. This micro-switch 160 also may be utilized to give an indication that the annular groove 130 has passed by the micro-switch_160 toward the rear wall 24 of the module 20 and in the opposite direction during an engaging step in which the high voltage connector 32 is brought into electrically engaging contact with the high voltage connector receptor 34. Alternatively, the cable 37 may be completely removed during shipment prior to first installation or after removal of the module 20 for maintenance, and inserted when the module 20 is first installed or replaced after maintenance, so that the cable 37 is in the thrust through position.

During such an engaging step, after the module 20 has been inserted or re-inserted, the inner tube 110 may be withdrawn through the base tube 80 in which it is snuggly fit and frictionally engaging, but still slideably engaging the base tube, to a position where the clamp 140 again is in engagement with the annular groove 130 and the high voltage connector in turn is within the opening 178 of the high voltage connector receptor 32.

It will be understood that the limit switches 146 and 160 may provide interlocking and safety inputs to a controller (not shown) to permit connecting high voltage to the cable 36 when the high voltage connector 32 is in the operating position and to not permit such application of high voltage when the high voltage connector 32 is in any other position, including the "housed" position. The connector 32 and connector receptor 34, therefore, form a "push-through" high voltage connector, i.e., the connector 32 and the cable 37 to which it is attached, including at least that part of the cable forming the high voltage connection wire 37 and a surrounding insulation cladding, moves through the connector receptor from a contact position to a housed position in a direction away from the neighboring module to which high voltage connection is desired when the cable 36 is moved from the housed position to the connecting position moving the cable 36 in the opposite direction, i.e., toward the neighboring module.

It will be understood that an adjacent module, e.g., a commutator module may have an essentially identical arrangement as that shown in FIGS. 1–14, with the modification, however, that when the cable 37 is moved from the "housed" position in the one module, e.g., the compression head module 20 of FIGS. 1–14 the cable 37 with its own high voltage connector 32' (not shown) moves toward electrically connective contact with a high voltage connector receptor 34' (not shown), and both high voltage connectors 32 and 32' (not shown) are brought into electrically connective contact with the respective high voltage contact receptor 34 and 34' (not shown) respectively by the same such movement of the cable 37.

In this manner a relatively thick and inflexible cable 37 may be used to interconnect two high voltage modules in relatively close proximity without bends of loops in the cable 37 which can lead to unwanted inductances and at the same time may be connected and disconnected from each other with relative ease with the modules installed in a cabinet having relatively close proximity and little flexibility of relative movement for purposes of connecting/disconnecting the cable ends to the respective module(s).

Figure 15:
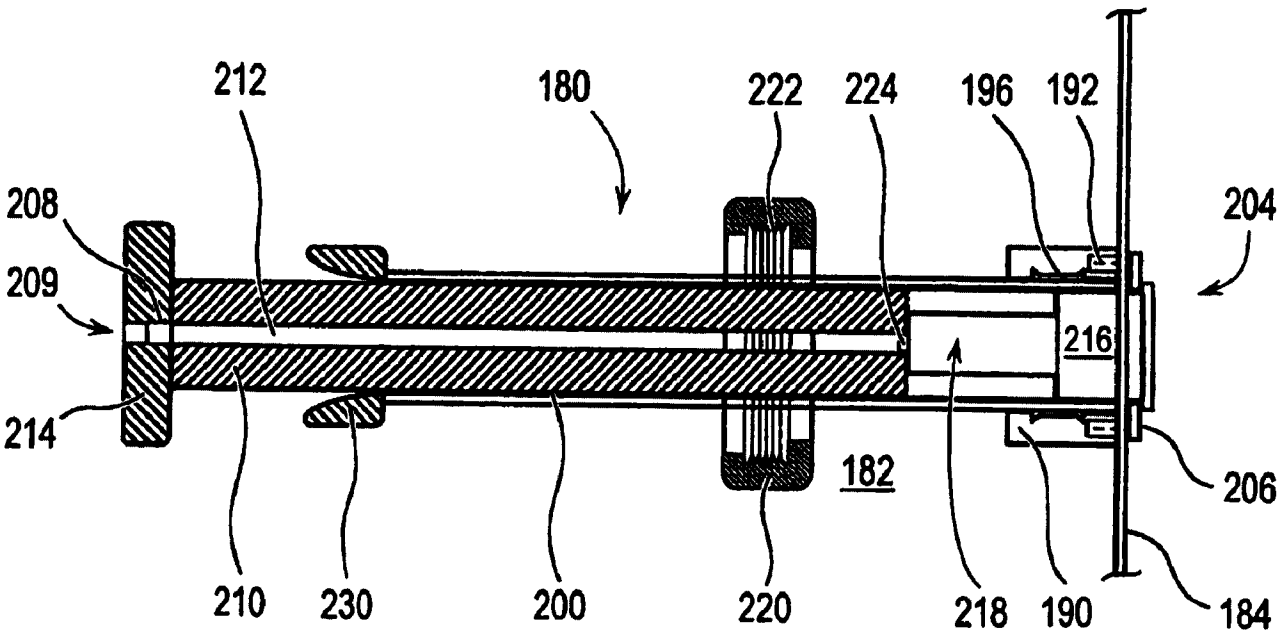
FIG. 15 shows a cross-sectional view of a second embodiment of the present invention in a contact position.
Figure 16:
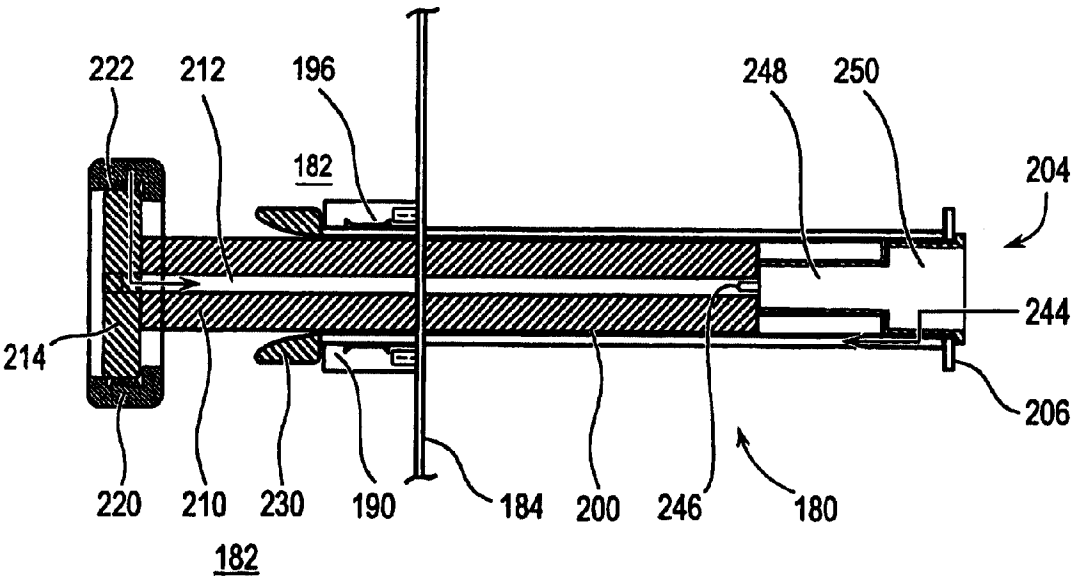
FIG. 16 shows a cross-sectional view of the second embodiment of FIG. 15 in a housed position; and, FIG. 17 shows a perspective view of a coaxial cable connector according to the second embodiment of FIGS. 15 and 16.
Figure 17:
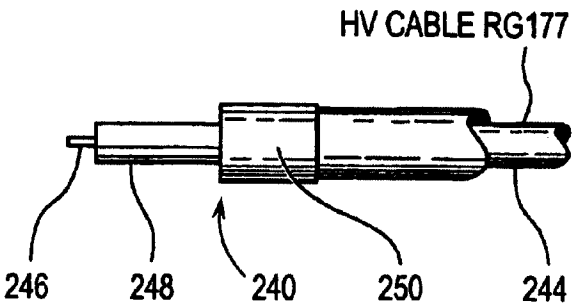

To add even more flexibility to the connecting/disconnecting process another embodiment of the present invention may be utilized, e.g., as shown in FIGS. 15–17, a retractable connector 180 may be formed in the other module, e.g., a high voltage module, e.g., a commutator module 182.

Turning now to FIGS. 15–17 there is shown an alternative embodiment of the present invention embodied in a retractable high voltage connector 180, which is shown in cross section in FIG. 15 in a retracted/disconnected position and in cross section in FIG. 16 in an extended/connected position. The retractable high voltage connector 180 may contain, e.g., a base tube 190 which may consist of a short cylindrical tube 190 contained within the interior of the high voltage module 182, and attached to the wall 184 by screws 192. The base tube 190 may also include within its interior cylindrical opening 204 an annular Multilam contact 196, made by Multi-contact USA, which may be utilized for frictional engagement on the interior wall of the base tube 190 to frictionally engage an inner tube 200. The inner tube 200 may be formed of an elongated cylindrical tube having at one end a flange 206.

The inner tube 200 may also contain a high voltage cable wire 212 which may be surrounded by insulating material 210, e.g., plastic, such as Teflon, which may be attached to the interior wall surface of the inner tube 200, e.g., by adhesive, which also may be formed into an elongated cylinder surrounding and coaxial with the high voltage contact wire 212. Attached to the end of the insulating material 210 and in electrical connection with the wire 212, e.g., through an end cap 208 may be a donut-shaped high voltage connector 214. The end cap 208 may be inserted into the central opening 209 of the donut-shaped connector 214 and the donut-shaped connector 214 may be attached to the insulating material 210 by any suitable means, e.g., by tapping the interior surface of the hole 209 and threading the outer surface of the end cap 208. Alternatively, the end cap 208 could be soldered to the connector 214.

In the other end of the inner tube 200 may be formed an opening 216 for receiving and locking a coaxial cable connector 240 (shown in FIG. 20). The opening 216 may be narrowed into a coaxial cable reception passage 218 by an internal sleeve 226, which may lead to a banana plug receptor 224 formed in the insulating material 210 and in electrical contact with the high voltage connector wire 212.

The wider portion 216 of the opening 204 may be internally threaded to receive threads (not shown) formed externally on a coaxial cable connector locking plug 250 forming a portion of a coaxial cable connector 240. The locking plug 250 may have an internal passage through which may be inserted the coaxial cable, with a portion of the outer insulator stripped away in order to make ground connection through the locking plug, made of a suitable electrically conductive material, e.g., brass, and the wall of the inner tube 210 in contact with the base tube 190 and the wall 184 of the grounded commutator module 182 wall 184. As can be seen in FIG. 20, the insulator outer sleeve 244 of the coaxial cable extends from the exterior end of the connector locking plug 250 while the high voltage wire with attached banana plug 246, shielded by a surrounding tube of insulating material, e.g., plastic, e.g., Teflon 248 extends from the interior end of the connector plug 250 and is inserted into the passage 218 to make contact with the banana plug receptor 224 as the connector plug 250 is threaded into place. It will be understood by those skilled in the art that the connector plug 250 and the coaxial cable may be formed and connected in such a way, e.g., by forming the connector plug of two intermeshing coaxial cylinders, such that the threaded portion (not shown) of the connector plug 250 is rotationally moveable around the coaxial cable during the threaded insertion process so as not to have to twist the cable between the modules 20, 182 being electrically connected. Or, alternatively, such twisting may be tolerated because the other end of the coaxial cable, i.e., connector 32, is not yet inserted into its connector receptor 34 or the connector 32, if so inserted, is permitted to rotate within its connector receptor 34.

In operation, the retractable connector 180, when not in use may be in the housed position as shown, e.g., in FIG. 15, with the inner tube 210 retracted to essentially fully within the module 182. When electrical contact is desired, e.g., before the cable 36 has been moved into the contacting position, i.e., with the connector 32 engaged in the connector receptor 34, the retractable connector may be extracted from the module 182 by sliding the inner tube 200 through the base tube 190 until the high voltage connector 214 engages within a high voltage connector receptor 220, which may have within an interior cylindrical opening multilam frictional contacts 222. At this point also an annular stop ring 230 can be positioned on the end of the inner tube 210 so as to engage the interior end of the base tube, e.g., after passing through the interior opening of the connector receptor 220, thus establishing the extent of motion of the inner tube 200 in the extension/connection direction. The annular stop ring 230 may also provide electrical field grading.

At this point, the coaxial cable 37 and connector 32 may be moved into engagement with the connector receiver 34 in the other module, extending the connector plug 250 toward the opening 204 in the extended retractable connector 180 allowing the connector plug 250 to be threaded into the receiving opening 216 to made the banana plug 246 with the banana plug receptor 224, establishing high voltage electrical connection between the modules with a minimum of relatively inflexible cable between the two, with a minimum bending or flexing of the cable during connection and with a minimum of bend and an elimination of loops in the interconnecting high voltage cable, e.g., reducing to a minimum any stray inductance.

Those skilled in the art will appreciate that the present embodiment described of the present invention is for illustrative purposes only and that may modifications and changes well within the understanding and skill of those in the art may be made to the presently disclosed embodiment(s) without departing from the spirit and scope of the appended claims. The present invention, therefore, should not be considered to be limited to the presently preferred embodiment(s) as disclosed and should be considered to be of an extend covered by the appended claims and their equivalents.

We claim:

1. An apparatus for electrically connecting two closely positioned high voltage modules with little or no bend and without any loops in an electrical interconnecting coaxial cable, comprising:

a high voltage connector attached to at least a portion of the cable on at least one end of the cable;

a push through high voltage connector receptor within one module; and, a disconnection mechanism within the one module adapted to move the high voltage connector and the at least a portion of cable to which the high voltage connector is attached through the connector receptor from a contact position to a housed position in a direction away from the other module to which high voltage connection is to be made.

2. The apparatus of claim 1, further comprising:

a clamping mechanism in cooperative connection with the disconnection mechanism when the high voltage connector is in the contact position and cooperative with the clamping mechanism to prevent the high voltage connector from moving from the contact position.

3. The apparatus of claim 1 further comprising:

the high voltage connector receptor comprising:

an open cylindrical connector with a contacting surface contained on the interior wall of the cylindrical connector.

4. The apparatus of claim 3, further comprising:

a clamping mechanism in cooperative connection with the disconnection mechanism when the high voltage connector is in the contact position and cooperative with the disconnection mechanism to prevent the high voltage connector from moving from the contact position.

5. The apparatus of claim 3, further comprising:

an interlock mechanism in operative connection with the disconnection mechanism and adapted to provide an indication of the high voltage connector being in a position other than in the contact position relative to the connector receptor.

6. The apparatus of claim 5, further comprising:

a clamping mechanism in cooperative connection with the disconnection mechanism when the high voltage connector is in the contact position and cooperative with the disconnection mechanism to prevent the high voltage connector from moving from the contact position.

7. The apparatus of claim 5, further comprising:

an engaging mechanism engaging the cable and holding the cable in a fixed position relative to the disconnection mechanism as the high voltage connector moves between the contact position and the housed position.

8. The apparatus of claim 7, further comprising:

a clamping mechanism in cooperative connection with the disconnection mechanism when the high voltage connector is in the contact position and cooperative with the disconnection mechanism to prevent the high voltage connector from moving from the contact position.

9. The apparatus of claim 1, further comprising:

an interlock mechanism in operative connection with the disconnection mechanism and adapted to provide an indication of the high voltage connector being in a position other than in the contact position relative to the connector receptor.

10. The apparatus of claim 9, further comprising:

a clamping mechanism in cooperative connection with the disconnection mechanism when the high voltage connector is in the contact position and cooperative with the disconnection mechanism to prevent the high voltage connector from moving from the contact position.

11. The apparatus of claim 9, further comprising:

an engaging mechanism engaging the cable and holding the cable in a fixed position relative to the disconnection mechanism as the high voltage connector moves between the contact position and the housed position.

12. The apparatus of claim 11, further comprising:

a clamping mechanism in cooperative connection with the disconnection mechanism when the high voltage connector is in the contact position and cooperative with the disconnection mechanism to prevent the high voltage connector from moving from the contact position.

13. An apparatus for electrically connecting two closely positioned high voltage modules with little or no bend and without any loops in an electrical interconnecting coaxial cable, comprising:

a high voltage connector attached to at least a portion of the cable on at least one end of the cable;

a push through high voltage connector receptor means within one module for connecting and disconnecting the high voltage connector to the module; and, a disconnection means within the one module for positioning the high voltage connector and the at least a portion of cable to which the high voltage connector is attached in a housed position by moving the cable in a direction away from the other module to which high voltage connection is to be made.

14. The apparatus of claim 13, further comprising:

a clamping means in cooperative connection with the disconnection means when the high voltage connector is in the contact position and cooperative with the disconnection means to prevent the high voltage connector from moving from the contact position.

15. The apparatus of claim 13 further comprising:

the high voltage connector receptor comprising:

an open cylindrical connector with a contacting surface contained on the interior wall of the cylindrical connector.

16. The apparatus of claim 15, further comprising:

a clamping means in cooperative connection with the disconnection means when the high voltage connector is in the contact position and cooperative with the disconnection means to prevent the high voltage connector from moving from the contact position.

17. The apparatus of claim 15, further comprising:

an interlock means for, in cooperation with the disconnection means, providing an indication of the high voltage connector being in a position other than in the contact position relative to the connector receptor.

18. The apparatus of claim 17, further comprising:

a clamping means in cooperative connection with the disconnection means when the high voltage connector is in the contact position and cooperative with the disconnection means to prevent the high voltage connector from moving from the contact position.

19. The apparatus of claim 17, further comprising:

an engaging means for engaging the cable and holding the cable in a fixed position relative to the disconnection means as the high voltage connector moves between the contact position and the housed position.

20. The apparatus of claim 19, further comprising:

a clamping means in cooperative connection with the disconnection means when the high voltage connector is in the contact position and cooperative with the disconnection means to prevent the high voltage connector from moving from the contact position.

21. The apparatus of claim 13, further comprising:

an interlock means for, in cooperation with the disconnection means, providing an indication of the high voltage connector being in a position other than in the contact position relative to the connector receptor.

22. The apparatus of claim 21, further comprising:

a clamping means in cooperative connection with the disconnection means when the high voltage connector is in the contact position and cooperative with the disconnection means to prevent the high voltage connector from moving from the contact position.

23. The apparatus of claim 21, further comprising:

an engaging means for engaging the cable and holding the cable in a fixed position relative to the disconnection means as the high voltage connector moves between the contact position and the housed position.

24. The apparatus of claim 23, further comprising:

a clamping means in cooperative connection with the disconnection means when the high voltage connector is in the contact position and cooperative with the disconnection means to prevent the high voltage connector from moving from the contact position.

25. A method for electrically connecting two closely positioned high voltage modules with little or no bend and without any loops in an electrical interconnecting coaxial cable, comprising:

attaching a high voltage connector to at least a portion of the cable on at least one end of the cable;

providing a push through high voltage connector receptor within one module for connecting and disconnecting the high voltage connector to the module; and, positioning the high voltage connector and the at least a portion of cable to which the high voltage connector is attached in a housed position by moving the cable through the push through high voltage connector receptor in a direction away from the other module to which high voltage connection is to be made.

26. The method of claim 25 further comprising:

the high voltage connector receptor comprising:

an open cylindrical connector with a contacting surface contained on the interior wall of the cylindrical connector.

27. The method of claim 26, further comprising:

providing an indication of the high voltage connector being in a position other than in the contact position relative to the connector receptor to prevent energizing the cable when the connector is in other than the contact position.

28. The apparatus of claim 27, further comprising:

clamping the disconnection means to prevent the high voltage connector from moving from the contact position.

29. The method of claim 25, further comprising:

providing an indication of the high voltage connector being in a position other than in the contact position relative to the connector receptor to prevent energizing the cable when the connector is in other than the contact position.

30. The apparatus of claim 29, further comprising:

clamping the disconnection means to prevent the high voltage connector from moving from the contact position.

31. An apparatus for electrically connecting a first and a second closely positioned high voltage module with little or no bend and without any loops in an electrical interconnecting coaxial cable, comprising:

a first high voltage connector attached to at least a portion of the cable on one end of the cable and a second high voltage connector attached to at least a portion of the cable at a second end of the cable;

a push through high voltage connector receptor within the first module;

a disconnection mechanism within the first module adapted to move the high voltage connector and the at least a portion of cable to which the high voltage connector is attached through the connector receptor from a contact position to a housed position in a direction away from the other module to which high voltage connection is to be made; and a retractable connector within the second module moveable toward the first module from a retracted position into an extended position, in which extended position electrical contact is made with the second high voltage connector.

32. An apparatus for electrically connecting a first and a second closely positioned high voltage module with little or no bend and without any loops in an electrical interconnecting coaxial cable, comprising:

a first and a second high voltage connector attached to at least a portion of the cable on each end of the cable;

a push through high voltage connector receptor means within the first module for connecting and disconnecting the high voltage connector to the first module;

a disconnection means within the first module for positioning the high voltage connector and the at least a portion of cable to which the high voltage connector is attached in a housed position by moving the cable in a direction away from the other module to which high voltage connection is to be made; and, a retractable connector means within the second module moveable toward the first module from a retracted position into an extended position, for making electrical contact with the second high voltage connector.

33. A method for electrically connecting a first and a second closely positioned high voltage module with little or no bend and without any loops in an electrical interconnecting coaxial cable, comprising:

placing a first and a second high voltage connector on at least a portion of the cable on each end of the cable;

a push through high voltage connector receptor means within the first module for connecting and disconnecting the high voltage connector to the first module;

a disconnection means within the first module for positioning the high voltage connector and the at least a portion of cable to which the high voltage connector is attached in a housed position by moving the cable in a direction away from the other module to which high voltage connection is to be made; and, a retractable connector means within the second module moveable toward the first module from a retracted position into an extended position, for making electrical contact with the second high voltage connector.

34. An apparatus for electrically connecting two closely positioned high voltage modules with little or no bend and without any loops in an electrical interconnecting coaxial cable, comprising:

a high voltage connector electrically connected to at least a portion of the cable on at least one end of the cable;

a push through high voltage connector receptor within one module; and, a disconnection mechanism within the one module adapted to move the high voltage connector through the connector receptor from a contact position to a housed position in a direction away from the other module to which high voltage connection is to be made.

35. The apparatus of claim 34, further comprising:

a clamping mechanism in cooperative connection with the disconnection mechanism when the high voltage connector is in the contact position and cooperative with the clamping mechanism to prevent the high voltage connector from moving from the contact position.

36. The apparatus of claim 34 further comprising:

the high voltage connector receptor comprising:

an open cylindrical connector with a contacting surface contained on the interior wall of the cylindrical connector.

37. The apparatus of claim 36, further comprising:

a clamping mechanism in cooperative connection with the disconnection mechanism when the high voltage connector is in the contact position and cooperative with the disconnection mechanism to prevent the high voltage connector from moving from the contact position.

38. The apparatus of claim 36, further comprising:

an interlock mechanism in operative connection with the disconnection mechanism and adapted to provide an indication of the high voltage connector being in a position other than in the contact position relative to the connector receptor.

39. The apparatus of claim 38, further comprising:

a clamping mechanism in cooperative connection with the disconnection mechanism when the high voltage connector is in the contact position and cooperative with the disconnection mechanism to prevent the high voltage connector from moving from the contact position.

40. The apparatus of claim 38, further comprising:

an engaging mechanism engaging the cable and holding the cable in a fixed position relative to the disconnection mechanism as the high voltage connector moves between the contact position and the housed position.

41. The apparatus of claim 40, further comprising:

a clamping mechanism in cooperative connection with the disconnection mechanism when the high voltage connector is in the contact position and cooperative with the disconnection mechanism to prevent the high voltage connector from moving from the contact position.

42. The apparatus of claim 34, further comprising:

an interlock mechanism in operative connection with the disconnection mechanism and adapted to provide an indication of the high voltage connector being in a position other than in the contact position relative to the connector receptor.

43. The apparatus of claim 42, further comprising:

a clamping mechanism in cooperative connection with the disconnection mechanism when the high voltage connector is in the contact position and cooperative with the disconnection mechanism to prevent the high voltage connector from moving from the contact position.

44. The apparatus of claim 42, further comprising:

an engaging mechanism engaging the cable and holding the cable in a fixed position relative to the disconnection mechanism as the high voltage connector moves between the contact position and the housed position.

45. The apparatus of claim 44, further comprising:

a clamping mechanism in cooperative connection with the disconnection mechanism when the high voltage connector is in the contact position and cooperative with the disconnection mechanism to prevent the high voltage connector from moving from the contact position.

46. An apparatus for electrically connecting two closely positioned high voltage modules with little or no bend and without any loops in an electrical interconnecting coaxial cable, comprising:

a high voltage connector electrically connected to at least a portion of the cable on at least one end of the cable;

a push through high voltage connector receptor means within one module for connecting and disconnecting the high voltage connector to the module; and, a disconnection means within the one module for positioning the high voltage connector in a housed position by moving the connector through the connector receptor in a direction away from the other module to which high voltage connection is to be made.

47. The apparatus of claim 46, further comprising:

a clamping means in cooperative connection with the disconnection means when the high voltage connector is in the contact position and cooperative with the disconnection means to prevent the high voltage connector from moving from the contact position.

48. The apparatus of claim 46 further comprising:

the high voltage connector receptor comprising:

an open cylindrical connector with a contacting surface contained on the interior wall of the cylindrical connector.

49. The apparatus of claim 48, further comprising:

a clamping means in cooperative connection with the disconnection means when the high voltage connector is in the contact position and cooperative with the disconnection means to prevent the high voltage connector from moving from the contact position.

50. The apparatus of claim 48, further comprising:

an interlock means for, in cooperation with the disconnection means, providing an indication of the high voltage connector being in a position other than in the contact position relative to the connector receptor.

51. The apparatus of claim 50, further comprising:

a clamping means in cooperative connection with the disconnection means when the high voltage connector is in the contact position and cooperative with the disconnection means to prevent the high voltage connector from moving from the contact position.

52. The apparatus of claim 50, further comprising:

an engaging means for engaging the cable and holding the cable in a fixed position relative to the disconnection means as the high voltage connector moves between the contact position and the housed position.

53. The apparatus of claim 52, further comprising:

a clamping means in cooperative connection with the disconnection means when the high voltage connector is in the contact position and cooperative with the disconnection means to prevent the high voltage connector from moving from the contact position.

54. The apparatus of claim 46, further comprising:

an interlock means for, in cooperation with the disconnection means, providing an indication of the high voltage connector being in a position other than in the contact position relative to the connector receptor.

55. The apparatus of claim 54, further comprising:

a clamping means in cooperative connection with the disconnection means when the high voltage connector is in the contact position and cooperative with the disconnection means to prevent the high voltage connector from moving from the contact position.

56. The apparatus of claim 54, further comprising:

an engaging means for engaging the cable and holding the cable in a fixed position relative to the disconnection means as the high voltage connector moves between the contact position and the housed position.

57. The apparatus of claim 56, further comprising:

a clamping means in cooperative connection with the disconnection means when the high voltage connector is in the contact position and cooperative with the disconnection means to prevent the high voltage connector from moving from the contact position.

58. A method for electrically connecting two closely positioned high voltage modules with little or no bend and without any loops in an electrical interconnecting coaxial cable, comprising:

attaching a high voltage connector to at least a portion of the cable on at least one end of the cable;

providing a push through high voltage connector receptor within one module for connecting and disconnecting the high voltage connector to the module; and, positioning the high voltage connector in a housed position by moving the connector through the push through high voltage connector receptor in a direction away from the other module to which high voltage connection is to be made.

59. The method of claim 58 further comprising:

the high voltage connector receptor comprising:

an open cylindrical connector with a contacting surface contained on the interior wall of the cylindrical connector.

60. The method of claim 59, further comprising:

providing an indication of the high voltage connector being in a position other than in the contact position relative to the connector receptor to prevent energizing the cable when the connector is in other than the contact position.

61. The apparatus of claim 60, further comprising:

clamping the disconnection means to prevent the high voltage connector from moving from the contact position.

62. The method of claim 58, further comprising:

providing an indication of the high voltage connector being in a position other than in the contact position relative to the connector receptor to prevent energizing the cable when the connector is in other than the contact position.

63. The apparatus of claim 62, further comprising:

clamping the disconnection means to prevent the high voltage connector from moving from the contact position.

64. An apparatus for electrically connecting a first and a second closely positioned high voltage module with little or no bend and without any loops in an electrical interconnecting coaxial cable, comprising:

a first high voltage connector electrically connected to at least a portion of the cable on one end of the cable and a second high voltage connector electrically connected to at least a portion of the cable at a second end of the cable;

a push through high voltage connector receptor within the first module;

a disconnection mechanism within the first module adapted to move the high voltage connector through the connector receptor from a contact position to a housed position in a direction away from the other module to which high voltage connection is to be made; and a retractable connector within the second module moveable toward the first module from a retracted position into an extended position, in which extended position electrical contact is made with the second high voltage connector.

65. An apparatus for electrically connecting a first and a second closely positioned high voltage module with little or no bend and without any loops in an electrical interconnecting coaxial cable, comprising:

a first and a second high voltage connector electrically connected to at least a portion of the cable on each end of the cable;

a push through high voltage connector receptor means within the first module for connecting and disconnecting the high voltage connector to the first module;

a disconnection means within the first module for positioning the high voltage connector in a housed position by moving the cable in a direction away from the other module to which high voltage connection is to be made; and, a retractable connector means within the second module moveable toward the first module from a retracted position into an extended position, for making electrical contact with the second high voltage connector.

66. A method for electrically connecting a first and a second closely positioned high voltage module with little or no bend and without any loops in an electrical interconnecting coaxial cable, comprising:

electrically connecting a first and a second high voltage connector to at least a portion of the cable on each end of the cable;

providing a push through high voltage connector receptor within the first module for connecting and disconnecting the high voltage connector to the first module;

disconnecting the high voltage connector within the first module by positioning the high voltage connector in a housed position by moving the connector in a direction away from the other module to which high voltage connection is to be made; and, providing a retractable connector within the second module moveable toward the first module from a retracted position into an extended position and making electrical contact with the second high voltage connector in the extended position.

* * * * *